US008405055B2

(12) United States Patent
Labetski et al.

(10) Patent No.: US 8,405,055 B2
(45) Date of Patent: Mar. 26, 2013

(54) SOURCE MODULE, RADIATION SOURCE AND LITHOGRAPHIC APPARATUS

(75) Inventors: Dzmitry Labetski, Utrecht (NL); Vadim Yevgenyevich Banine, Deurne (NL); Erik Roelof Loopstra, Eindhoven (NL); Johannes Hubertus Josephina Moors, Helmond (NL); Gerardus Hubertus Petrus Maria Swinkels, Eindhoven (NL)

(73) Assignee: ASML Netherlands B.V., Veldhoven (NL)

( * ) Notice: Subject to any disclaimer, the term of this patent is extended or adjusted under 35 U.S.C. 154(b) by 521 days.

(21) Appl. No.: 12/566,060

(22) Filed: Sep. 24, 2009

(65) Prior Publication Data

US 2010/0085547 A1 Apr. 8, 2010

Related U.S. Application Data

(60) Provisional application No. 61/136,686, filed on Sep. 25, 2008, provisional application No. 61/193,704, filed on Dec. 17, 2008.

(51) Int. Cl.
*H05H 1/42* (2006.01)

(52) U.S. Cl. ..... 250/504 R; 250/492.2; 250/492.1

(58) Field of Classification Search ..... 250/504 R, 250/492
See application file for complete search history.

(56) References Cited

U.S. PATENT DOCUMENTS

| | | | | |
|---|---|---|---|---|
| 7,332,731 | B2 * | 2/2008 | Klunder et al. | 250/504 R |
| 7,671,349 | B2 * | 3/2010 | Bykanov et al. | 250/504 R |
| 2008/0048133 | A1 | 2/2008 | Bykanov et al. | |

FOREIGN PATENT DOCUMENTS

| | | | |
|---|---|---|---|
| EP | 1 775 755 | A1 | 4/2007 |
| JP | 2007-134166 | A | 5/2007 |
| WO | 2006/123270 | A2 | 11/2006 |
| WO | 2007/005414 | A2 | 1/2007 |

OTHER PUBLICATIONS

Partial European Search Report for European Application No. EP 09 16 9681 dated Dec. 7, 2009.

* cited by examiner

*Primary Examiner* — Jack Berman
(74) *Attorney, Agent, or Firm* — Pillsbury Winthrop Shaw Pittman LLP

(57) ABSTRACT

A radiation source is configured to generate extreme ultraviolet radiation. The radiation source includes a fuel supply configured to supply a fuel to a plasma formation site; a laser configured to emit a beam of radiation to the plasma formation site so that a plasma that emits extreme ultraviolet radiation is generated when the beam of radiation impacts the fuel; a fuel particulate interceptor constructed and arranged to shield at least part of the radiation source from fuel particulates that are emitted by the plasma, the fuel particulate interceptor comprising a first portion and a second portion, the second portion being positioned closer to the plasma formation site than the first portion, and the first portion being rotatable; and a fuel particulate remover constructed and arranged to remove fuel particulates from a surface of the fuel particulate interceptor and to direct the fuel particulates towards a collection location.

14 Claims, 7 Drawing Sheets

SOURCE MODULE, RADIATION SOURCE AND LITHOGRAPHIC APPARATUS

CROSS-REFERENCE TO RELATED APPLICATIONS

This application claims the benefit of priority from U.S. Provisional Patent Application Ser. Nos. 61/136,686, filed on Sep. 25, 2008, and 61/193,704, filed on Dec. 17, 2008, the entire contents of both applications are incorporated herein by reference.

FIELD

The present invention relates to an extreme ultraviolet (EUV) radiation source, and a lithographic apparatus that includes such a source.

BACKGROUND

A lithographic apparatus is a machine that applies a desired pattern onto a substrate, usually onto a target portion of the substrate. A lithographic apparatus can be used, for example, in the manufacture of integrated circuits (ICs). In that instance, a patterning device, which is alternatively referred to as a mask or a reticle, may be used to generate a circuit pattern to be formed on an individual layer of the IC. This pattern can be transferred onto a target portion (e.g. comprising part of, one, or several dies) on a substrate (e.g. a silicon wafer). Transfer of the pattern is typically via imaging onto a layer of radiation-sensitive material (resist) provided on the substrate. In general, a single substrate will contain a network of adjacent target portions that are successively patterned. Known lithographic apparatus include so-called steppers, in which each target portion is irradiated by exposing an entire pattern onto the target portion at one time, and so-called scanners, in which each target portion is irradiated by scanning the pattern through a radiation beam in a given direction (the "scanning"-direction) while synchronously scanning the substrate parallel or anti-parallel to this direction.

In order to be able to project ever smaller structures onto substrates, it has been proposed to use EUV radiation which is electromagnetic radiation having a wavelength within the range of 10-20 nm, for example within the range of 13-14 nm. It has further been proposed that EUV radiation with a wavelength of less than 10 nm could be used, for example within the range of 5-10 nm such as 6.7 nm or 6.8 nm.

Radiation may be produced using plasma. The plasma may be created, for example, by directing a laser at a fuel, such as particles of a suitable material (e.g. tin), or a stream of a suitable gas or vapor, such as Xe gas or Li vapor. The resulting plasma emits output radiation, e.g., EUV radiation, which is collected using a radiation collector such as a mirrored normal incidence radiation collector, which receives the radiation and focuses the radiation into a beam. Such a radiation source is typically termed a laser produced plasma (LPP) source.

In addition to radiation, the plasma of a plasma radiation source produces contamination in the form of particles, such as thermalized atoms, ions, nanoclusters, and/or microparticles. The contamination is output, together with the desired radiation, from the radiation source towards the radiation collector and may cause damage to the normal incidence radiation collector and/or other parts. For example, LPP sources that use tin (Sn) droplets to produce the desired EUV may generate a large amount of tin debris in the form of: atoms, ions, nanoclusters, and/or microparticles. Herebelow, reference is made to the term particulate, which means to encompass any debris or contamination in the form of atoms/ions or atom clusters from the fuel source. It is desirable to prevent the debris from reaching the radiation collector, where it may reduce EUV power, or end somewhere in the source vessel where it may create other problems. To stop especially the ions, a buffer gas can be used, but with this kind of debris mitigation, a large flow of buffer gas may be needed, which may make it desirable to have large pumps and a large supply of buffer gas. Due to the large flow of the buffer gas, the plasma region may become instable, but the flow may not stop micro-droplets of fuel from being deposited on the walls of the source vacuum chamber.

In addition, EUV LPP sources generate a large amount of fuel debris of which a part may be deposited in the central cone. The present invention is concerned with preventing build up of fuel debris deposits in the inner cone, of which uncontrolled release may damage the optics arranged in the plasma source.

SUMMARY

It is desirable to remove fuel debris before the debris reaches the radiation collector. It is also desirable to avoid accumulation of any fuel debris onto surfaces within a radiation source.

According to an aspect of the invention, there is provided a source module for a lithographic apparatus. The source module includes a chamber defined by chamber walls, an extreme ultraviolet radiation generator that includes a fuel supply configured to supply a fuel to a plasma formation site within the chamber, a reflective element in the chamber configured to reflect extreme ultraviolet radiation emanating from a radiation emission point at the plasma formation site; and a fuel particulate interceptor, arranged in the chamber adjacent to one or more of the chamber walls, and comprising a material having an affinity for the fuel. A laser may be configured to emit a beam of radiation to the plasma formation site so that a plasma that emits extreme ultraviolet radiation is generated when the beam of radiation impacts the fuel. The fuel particulate interceptor is configured to collect fuel particulates emitted by the plasma. The fuel particulate interceptor is arranged in the chamber and comprises a material having an affinity for the fuel so that when the fuel particulates impact a surface of the fuel particulate interceptor, the fuel particulates will adhere to the surface. The fuel particulate interceptor is arranged relative to the reflective element so as to prevent any fuel particulates from falling under the influence of gravity onto the reflective element.

According to an aspect of the invention, there is provided a lithographic apparatus that includes the above-described source module and a projection system constructed and arranged to project the patterned radiation onto a substrate.

According to an aspect of the invention, there is provided a radiation source configured to generate extreme ultraviolet radiation. The radiation source includes a fuel supply configured to supply a fuel to a plasma formation site, a laser configured to emit a beam of radiation to the plasma formation site so that a plasma that emits extreme ultraviolet radiation is generated when the beam of radiation impacts the fuel, and a fuel particulate interceptor constructed and arranged to shield at least part of the radiation source from fuel particulates that are emitted by the plasma. The fuel particulate interceptor includes a first portion and a second portion, the second portion being positioned closer to the plasma formation site than the first portion, and the first portion being rotatable. The radiation source also includes a fuel particulate remover constructed and arranged to remove fuel particulates from a surface of the fuel particulate interceptor and to direct the fuel particulates towards a collection location.

According to an aspect of the invention, there is provided a lithographic apparatus that includes the above-described radiation source, and a projection system constructed and arranged to project the patterned radiation onto a substrate.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION

Figure 1:
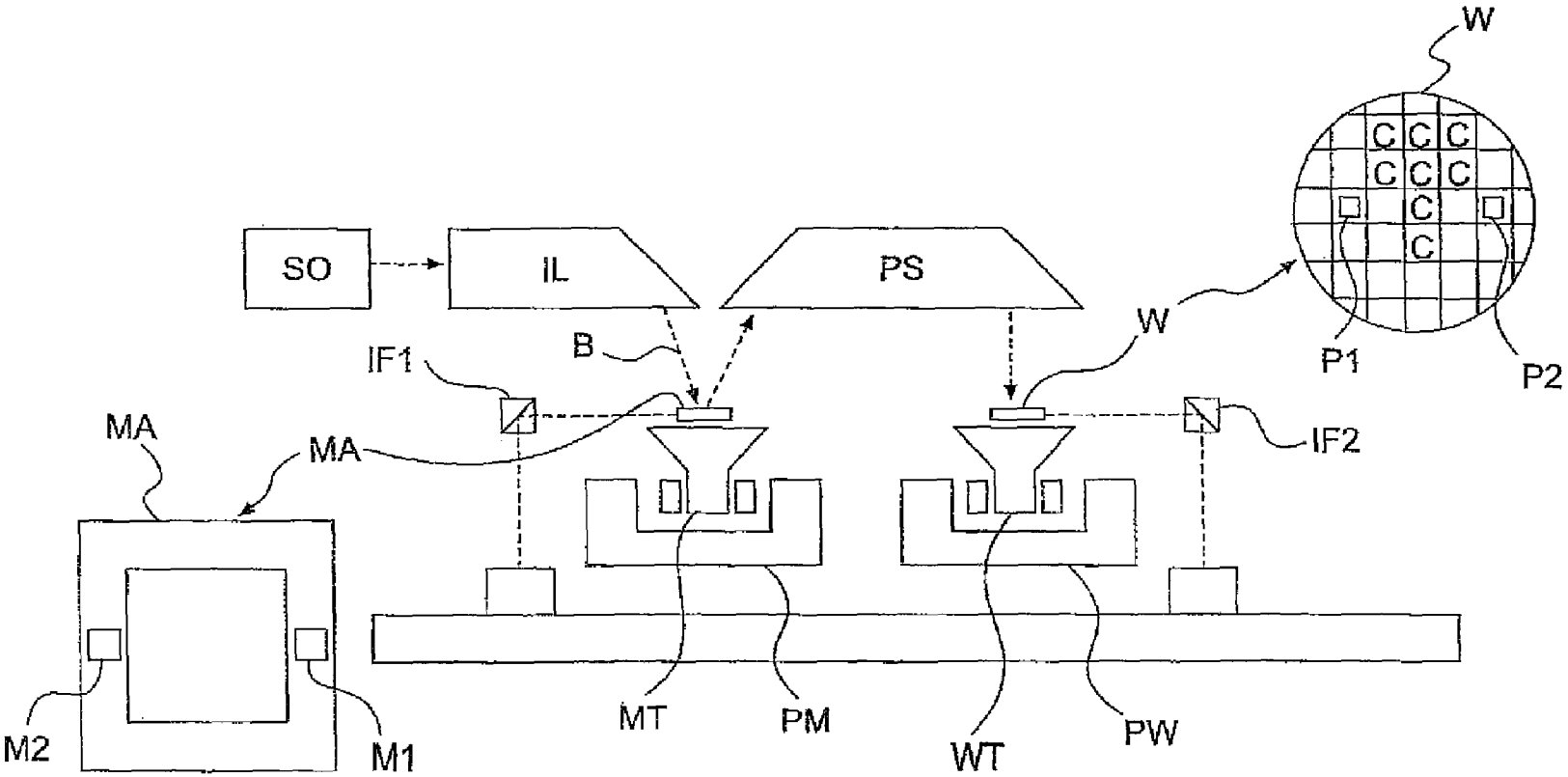
FIG. 1 schematically depicts a lithographic apparatus according to an embodiment of the invention.

FIG. 1 schematically depicts a lithographic apparatus according to an embodiment of the invention. The apparatus comprises: an illumination system (illuminator) IL configured to condition a radiation beam B of radiation. The apparatus also includes a support structure (e.g. a mask table) MT constructed to support a patterning device (e.g. a mask) MA and connected to a first positioner PM configured to accurately position the patterning device in accordance with certain parameters; a substrate table (e.g. a wafer table) WT constructed to hold a substrate (e.g. a resist-coated wafer) W and connected to a second positioner PW configured to accurately position the substrate in accordance with certain parameters; and a projection system (e.g. a refractive or reflective projection lens system) PS configured to project a pattern imparted to the radiation beam B by patterning device MA onto a target portion C (e.g. comprising one or more dies) of the substrate W.

The illumination system may include various types of optical components, such as refractive, reflective, magnetic, electromagnetic, electrostatic or other types of optical components, or any combination thereof, for directing, shaping, or controlling radiation.

The support structure MT holds the patterning device in a manner that depends on the orientation of the patterning device, the design of the lithographic apparatus, and other conditions, such as for example whether or not the patterning device is held in a vacuum environment. The support structure MT can use mechanical, vacuum, electrostatic or other clamping techniques to hold the patterning device. The support structure MT may be a frame or a table, for example, which may be fixed or movable as required. The support structure MT may ensure that the patterning device is at a desired position, for example with respect to the projection system. Any use of the terms "reticle" or "mask" herein may be considered synonymous with the more general teen "patterning device."

The term "patterning device" used herein should be broadly interpreted as referring to any device that can be used to impart a radiation beam with a pattern in its cross-section such as to create a pattern in a target portion of the substrate. It should be noted that the pattern imparted to the radiation beam may not exactly correspond to the desired pattern in the target portion of the substrate, for example if the pattern includes phase-shifting features or so called assist features. Generally, the pattern imparted to the radiation beam will correspond to a particular functional layer in a device being created in the target portion, such as an integrated circuit.

The patterning device may be reflective. Examples of patterning devices include masks, programmable mirror arrays, and programmable LCD panels. Masks are well known in lithography, and include mask types such as binary, alternating phase-shift, and attenuated phase-shift, as well as various hybrid mask types. An example of a programmable mirror array employs a matrix arrangement of small mirrors, each of which can be individually tilted so as to reflect an incoming radiation beam in different directions. The tilted mirrors impart a pattern in a radiation beam which is reflected by the mirror matrix.

The term "projection system" used herein should be broadly interpreted as encompassing any type of projection system, including refractive, reflective, catadioptric, magnetic, electromagnetic and electrostatic optical systems, or any combination thereof, as appropriate for the exposure radiation being used. Any use of the term "projection lens" herein may be considered as synonymous with the more general term "projection system".

As here depicted, the apparatus is of a reflective type (e.g. employing a reflective mask).

The lithographic apparatus may be of a type having two (dual stage) or more substrate tables (and/or two or more patterning device tables). In such "multiple stage" machines, the additional tables may be used in parallel, or preparatory steps may be carried out on one or more tables while one or more other tables are being used for exposure.

Referring to FIG. 1, the illuminator IL receives a radiation beam from a radiation source SO. The radiation source SO includes an EUV radiation generator, such as for example an LPP radiation generator, and collector optic for collecting radiation emanating from a radiation emission point of the EUV radiation generator. In an embodiment, the source SO may include the collector optic. Alternatively, the collector optic may be part of the lithographic apparatus, or may be part of both the source SO and the lithographic apparatus. In an embodiment, the source and the lithographic apparatus may be separate entities. In such a case, where the radiation source SO includes the collector optic, the collector optic is not considered to form part of the lithographic apparatus. Where the source SO including the collector optic is a separate entity, the radiation beam may be passed from the collector optic of the radiation source SO to the illuminator IL with the aid of a beam delivery system comprising, for example, suitable directing mirrors and/or a beam expander. In other cases the source and the collector optic (whether the collector optic is part of the source or otherwise part of the lithographic apparatus) may be an integral part of the lithographic apparatus. The collector optic, the source SO and the illuminator IL, together with the beam delivery system if required, may be referred to as a radiation system. The illuminator IL may comprise an adjuster for adjusting the angular intensity distribution of the radiation beam. Generally, at least the outer and/or inner radial extent (commonly referred to as σ-outer and σ-inner, respectively) of the intensity distribution in a pupil plane of the illuminator can be adjusted. In addition, the illuminator IL may comprise various other components, such as an integrator and a condenser. The illuminator may be used to condition the radiation beam, to have a desired uniformity and intensity distribution in its cross-section.

The radiation beam B is incident on the patterning device (e.g., mask) MA, which is held on the support structure (e.g., mask table) MT, and is patterned by the patterning device. Having traversed the patterning device MA, the radiation beam B passes through the projection system PS, which focuses the beam onto a target portion C of the substrate W. With the aid of the second positioner PW and position sensor IF2 (e.g. an interferometric device, linear encoder or capacitive sensor), the substrate table WT can be moved accurately, e.g. so as to position different target portions C in the path of the radiation beam B. Similarly, the first positioner PM and another position sensor IF1 can be used to accurately position the patterning device MA with respect to the path of the radiation beam B, e.g. after mechanical retrieval from a mask library, or during a scan. In general, movement of the support structure MT may be realized with the aid of a long-stroke module (coarse positioning) and a short-stroke module (fine positioning), which form part of the first positioner PM. Similarly, movement of the substrate table WT may be realized using a long-stroke module and a short-stroke module, which form part of the second positioner PW. In the case of a stepper (as opposed to a scanner) the support structure MT may be connected to a short-stroke actuator only, or may be fixed. Patterning device MA and substrate W may be aligned using patterning device alignment marks M1, M2 and substrate alignment marks P1, P2. Although the substrate alignment marks as illustrated occupy dedicated target portions, they may be located in spaces between target portions (these are known as scribe-lane alignment marks). Similarly, in situations in which more than one die is provided on the patterning device MA, the patterning device alignment marks may be located between the dies.

The depicted apparatus could be used in at least one of the following modes:

1. In step mode, the support structure MT and the substrate table WT are kept essentially stationary, while an entire pattern imparted to the radiation beam is projected onto a target portion C at one time (i.e. a single static exposure). The substrate table WT is then shifted in the X and/or Y direction so that a different target portion C can be exposed. In step mode, the maximum size of the exposure field limits the size of the target portion C imaged in a single static exposure.

2. In scan mode, the support structure MT and the substrate table WT are scanned synchronously while a pattern imparted to the radiation beam is projected onto a target portion C (i.e. a single dynamic exposure). The velocity and direction of the substrate table WT relative to the support structure MT may be determined by the (de-)magnification and image reversal characteristics of the projection system PS. In scan mode, the maximum size of the exposure field limits the width (in the non-scanning direction) of the target portion in a single dynamic exposure, whereas the length of the scanning motion determines the height (in the scanning direction) of the target portion.

3. In another mode, the support structure MT is kept essentially stationary holding a programmable patterning device, and the substrate table WT is moved or scanned while a pattern imparted to the radiation beam is projected onto a target portion C. In this mode, generally a pulsed radiation source is employed and the programmable patterning device is updated as required after each movement of the substrate table WT or in between successive radiation pulses during a scan. This mode of operation can be readily applied to maskless lithography that utilizes programmable patterning device, such as a programmable mirror array of a type as referred to above.

Combinations and/or variations on the above described modes of use or entirely different modes of use may also be employed.

Figure 2:
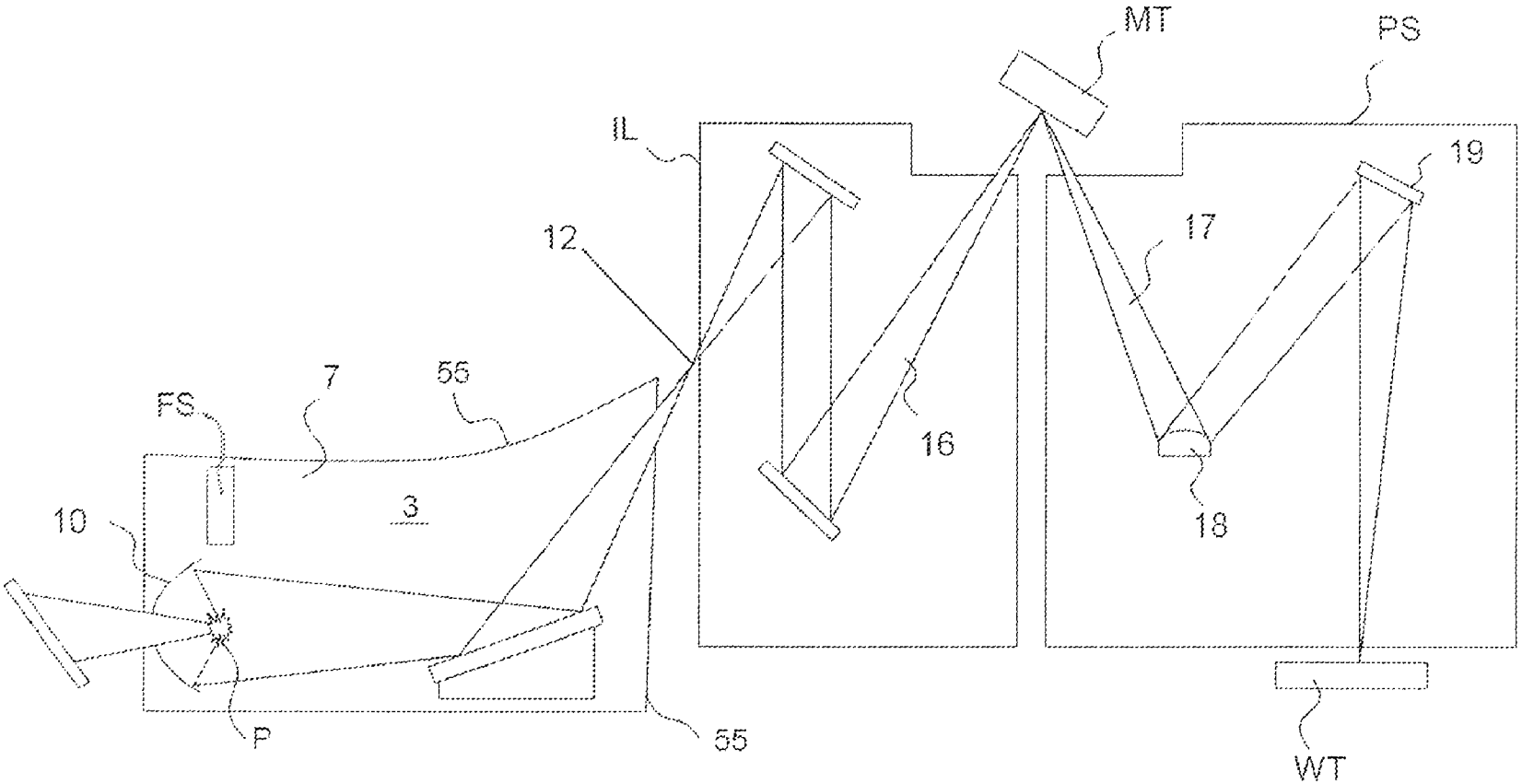
FIG. 2 depicts a lithographic apparatus in accordance with an embodiment of the invention.

FIG. 2 schematically shows a further embodiment of an EUV lithographic apparatus, having a principle of operation that is similar to the operation of the apparatus shown in the embodiment of FIG. 1. In the embodiment of FIG. 2, the apparatus includes a source-module or radiation unit 3 in this case part of the radiation source SO, an illumination system IL and a projection system PS. The source-module 3 includes a chamber 7 comprising a collector 10 and a EUV radiation generator. The EUV radiation generator includes a fuel supply FS configured to supply a fuel to a plasma formation site within the chamber 7. In use, upon excitation of the plasma at the plasma formation site, there is provided a radiation emission point P, i.e. a localized portion of plasma emitting EUV radiation. The emission point P is also referred to as the plasma P hereinafter. Desirably, the EUV radiation generator is a laser produced plasma ("LPP") source. The chamber 7 includes and is defined by chamber walls 55, arranged, for example, to enable a vacuum environment in the chamber 7. In the present embodiment, the radiation emitted from the plasma P may be passed from the source chamber 7 into illuminator IL. As schematically illustrated in FIG. 2, the collector optic 10 may be a reflective collector.

FIG. 2 depicts the application of a normal incidence radiation collector 10 in combination with a laser produced plasma (LPP) source. However, the radiation collector may be a grazing incidence collector, particularly in the case the source is a discharge produced plasma (DPP) source. In yet another embodiment, the radiation collector may be a Schwarzschild radiation collector, and the source may be a DPP source.

The radiation may be focused in a virtual source point 12 (i.e. an intermediate focus IF) disposed at or near an aperture in the chamber 7. From chamber 7, the radiation beam 16 is reflected in illumination system IL. A patterned beam 17 is formed which is imaged by projection system PS via reflective elements 18,19 onto wafer stage or substrate table WT. More elements than shown may generally be present in the illumination system IL and the projection system PS.

One of the reflective elements 19 may have in front of it a numerical aperture (NA) disc having an aperture therethrough. The size of the aperture determines an angle subtended by the patterned radiation beam 17 as it strikes the substrate table WT.

In other embodiments, the radiation collector is one or more of a radiation collector configured to focus collected radiation into the intermediate focus IF; a radiation collector having a first focal point that coincides with the source and a second focal point that coincides with afore mentioned intermediate focus IF; a normal incidence radiation collector; a radiation collector having a single substantially ellipsoid radiation collecting surface section; and a Schwarzschild radiation collector having two radiation collecting surfaces.

Also, in another embodiment, the EUV radiation generator may be a laser produced plasma (LPP) source including a light source, such as for example a $CO_2$ laser, that is configured to focus a beam of coherent light, of a predetermined wavelength, onto a fuel such that a plasma is produced that emits at least EUV radiation. In an embodiment, the radiation source may be a discharge produced plasma (DPP) source.

Figure 3:
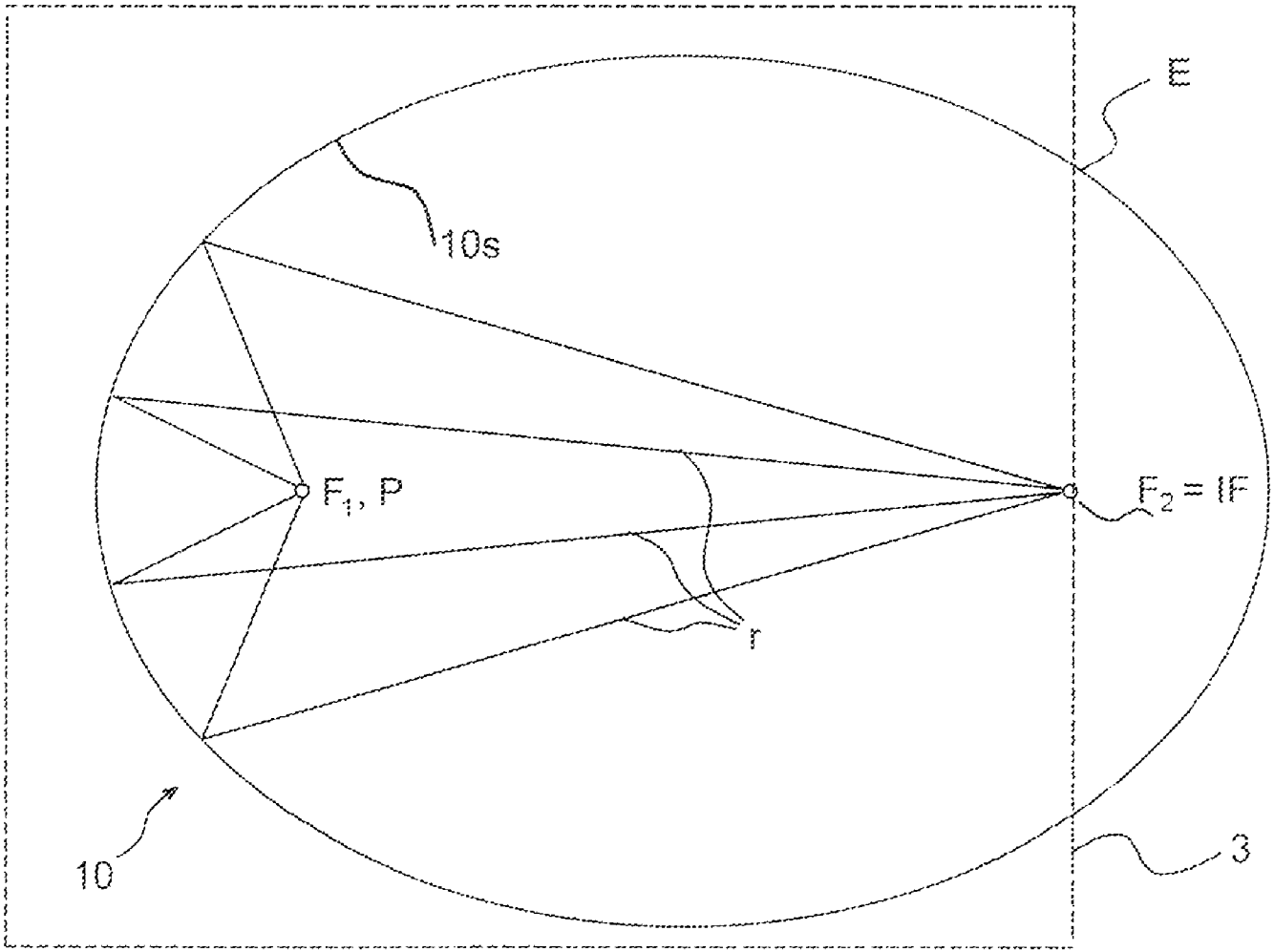
FIG. 3 depicts a source module and a normal incidence radiation collector in accordance with an embodiment of the invention.

FIG. 3 shows an embodiment of a radiation source module 3, in cross-section, that includes a normal incidence radiation collector 10. The radiation collector 10 has an elliptical configuration, having two natural ellipse focus points F1, F2. Particularly, the normal incidence radiation collector includes a radiation collector having a single radiation collecting surface 10*s* having the geometry of a section of an ellipsoid. In other words: the ellipsoid radiation collecting surface section extends along a virtual ellipsoid, depicted by line E in the drawing.

In case the source SO of the embodiment shown in FIG. 1 includes an LPP radiation source, the radiation collector may be a single ellipsoidal mirror as shown in FIG. 3, where the radiation emission point is positioned in one focal point (F1) and an intermediate focus IF is established in the other focal point (F2) of the mirror. Radiation emanating from the radiation emission point, located in the first focal point (F1), propagates towards the reflecting surface 10*s* and the reflected radiation, reflected by that surface towards the second focus point F2, is depicted by lines r in the drawing. For example, according to an embodiment, a mentioned intermediate focus IF may be located between the radiation collector and an illumination system IL (see FIGS. 1, 2) of a lithographic apparatus, or be located in the illumination system IL, if desired.

Figure 4:
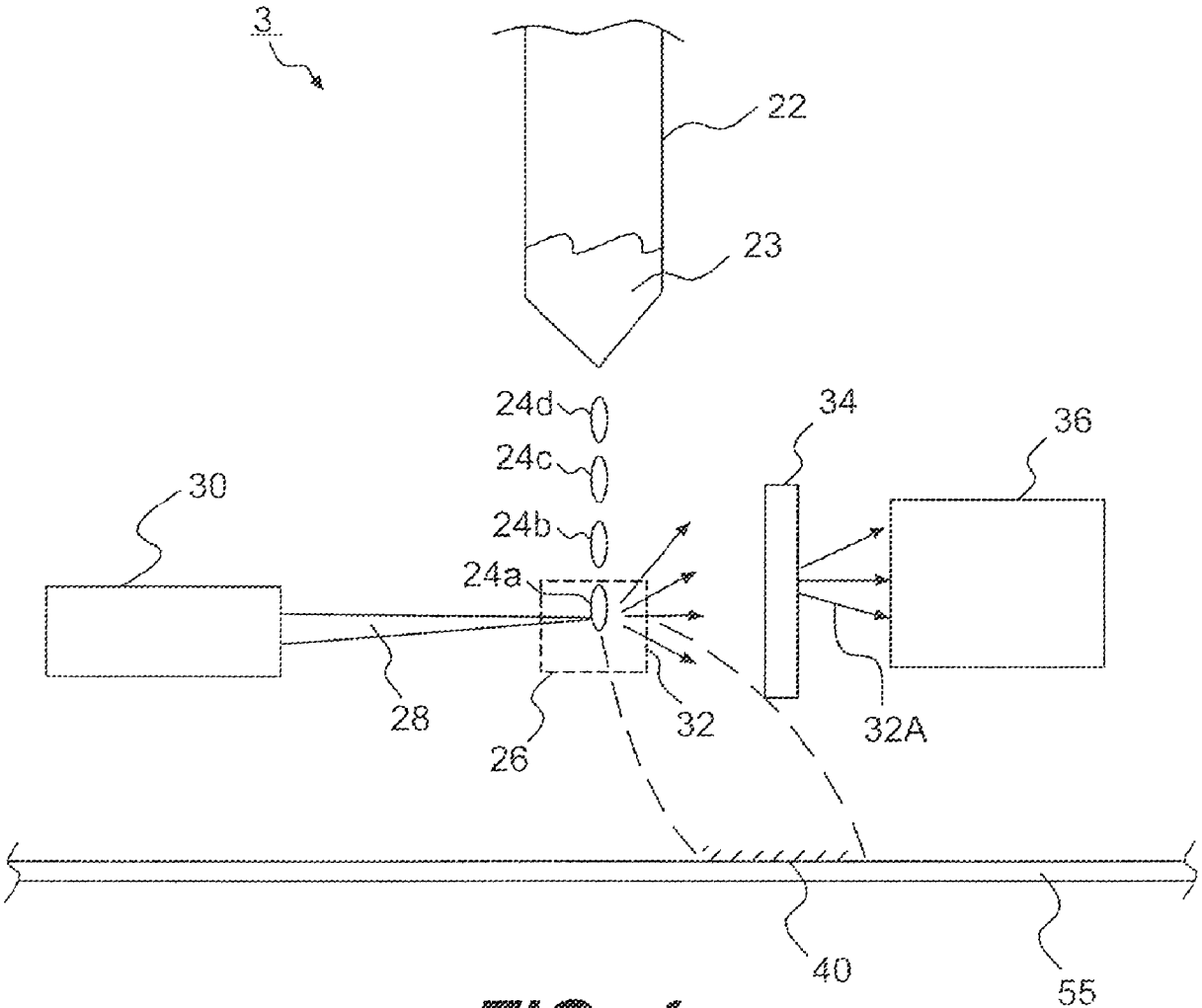
FIG. 4 depicts a source module including a radiation generator in accordance with an embodiment of the invention.

FIG. 4 schematically depicts a radiation source module according to an embodiment of the invention. The radiation source module 3 may comprise a droplet generator 22 that is constructed and arranged to turn a liquefied fuel (target material) 23, for example Sn, into droplets. The droplet generator 22 may be arranged with a suitable mechanism or opening (not shown) for delivery of liquid droplets 24*a*, 24*b*, 24*c*, 24*d* of Sn to the region 26 wherein a droplet is configured to be impinged by a radiation beam 28, such as a laser beam, that is provided by a radiation emitter 30, such as a laser. The laser beam 28 may relate to a $CO_2$ laser having a wavelength of 10.6 micrometers. Alternatively, other suitable radiation emitters or lasers may be used having respective wavelengths in the range of 1-11 micrometers. The laser beam is desirably focused in the region 26, which may be referred to as a plasma formation site, using a suitable optical system (not shown). Upon interaction with the laser beam the droplets 24*a*, 24*b*, 24*c*, 24*d* are transferred into plasma state which may emit a 6.7 nm radiation, or any other EUV radiation in the range of 5-20 nanometers.

The emanating EUV beam 32 may be intercepted by a suitable debris mitigation system, such as contamination trap 34, configured to collect or to deflect particle debris emanating from the region 26. The EUV beam 32A substantially free of debris may then enter a subsequent optical system 36 of the radiation source or of the lithographic apparatus, such as illumination system IL of the lithographic apparatus configured to suitably condition the beam 32A. The radiation source module 3 may include a buffer gas for cooperating with a source of laser produced plasma. Desirably the buffer gas has high transmission for in-band EUV and absorbs secondary radiation. The buffer gas may have at least 50% transmission for the EUV radiation, and at least 70% absorption for the secondary radiation. Desirably, the buffer gas has at least 90% or at least 95% transmission for the EUV radiation. It is further desirable that the buffer gas has at least 90% absorption for the secondary radiation. In the embodiments illustrated in FIGS. 5-8, the buffer gas comprises hydrogen (H2). The contamination trap 34 may be a conventional foil trap, arranged to allow passage of extreme ultraviolet radiation, for example by providing debris trapping foils which locally extend parallel to a direction of propagation of corresponding local EUV radiation.

Typically, only a portion of the whole droplet of tin will contribute to EUV radiation generation and part of the droplet will be converted into debris. The debris may reduce the reflectivity of the radiation collector mirror, which may result in a decrease in productivity of the lithographic apparatus. The buffer gas may be provided to stop the tin debris (e.g., ions, particles, neutrals and vapor) from reaching the radiation collector 10. In instances where tin reaches the radiation collector 10, the tin may not be removed and/or when removed, the tin may deposit on unwanted surface. Without being bound to theory, plasma formation and fuel particulate formation in the plasma formation site may result in a dominant direction of fuel particulates resultant from the plasma formation site 26 (see FIG. 4). The dominant direction may be oriented in a lobe 40 away from the collector 10 due to plasma pressure formation by the impacting laser beam 28, and may be directed generally along a droplet movement direction. This may result in a dominant contamination region of the chamber walls 55. Desirably, a fuel particulate interceptor (see FIG. 5) is arranged in a dominant contamination region of the chamber.

Figure 5:
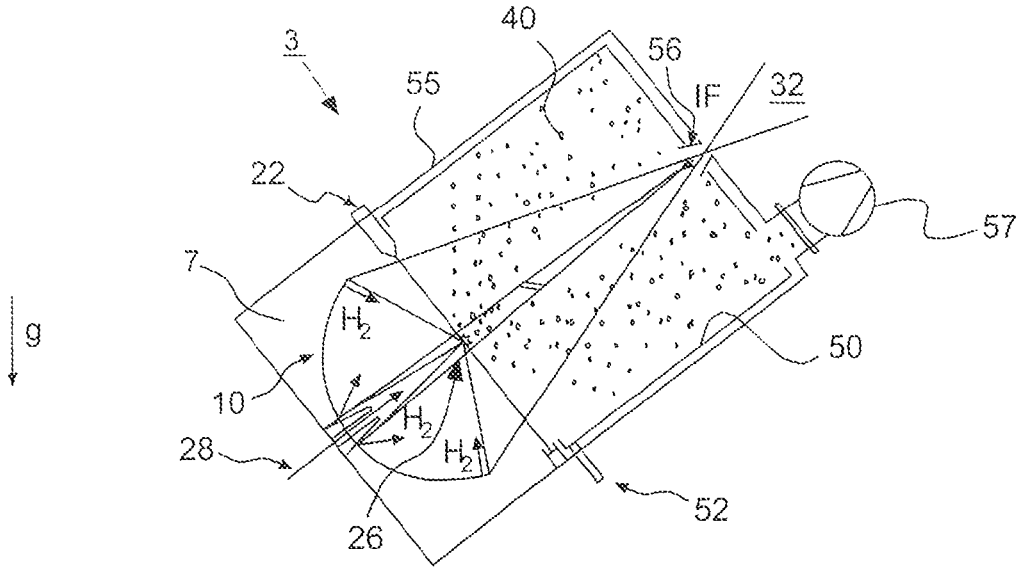
FIG. 5 depicts a source module including a fuel particulate interceptor in accordance with an embodiment of the invention.

FIG. 5 illustrates an embodiment of the source module 3 that includes a fuel particulate interceptor 50. The fuel particulate interceptor 50 may be inserted into the source chamber 7 close to or adjacent to at least some of the chamber walls 55. The fuel particulate interceptor 50 may be made from a fuel-resistant material, but at the same time the fuel resistant material should have affinity for the fuel, so that when micro-droplets of the fuel contact a surface of the fuel particulate interceptor, the micro-droplets stick to the surface. In an embodiment, for example, molybdenum may be used as the material for the fuel particulate interceptor 50. In the example of FIG. 5, the fuel particulate interceptor is shaped as a drum, or shield, arranged to substantially cover part of walls 55. In FIG. 5, the direction of gravity is shown with the arrow g. It is shown that a substantial part of the chamber walls 55 are located above the collector 10, which, in this example, is a reflective element configured in the chamber 7 to reflect the extreme ultraviolet radiation 32. Although, in this example, the reflective element is illustrated as a normal incidence collector 10 it should be noted that the interceptor 50 may also be arranged 'above' other reflective elements, such as grazing incidence collectors or other reflective optics. The interceptor 50 is formed from a material having an affinity for the fuel so that when the fuel particulates impact a surface of the fuel particulate interceptor, the fuel particulates will adhere to the surface. The fuel particulate interceptor 50 may be arranged relative to the reflective element 10 so as to prevent any fuel particulates from falling under the influence of gravity onto the reflective element 10.

During operation of the radiation source, the fuel particulate interceptor 50 is operative to intercept fuel particulate, debris and vapor 40, that is formed from the plasma formation site 26 which comprises aforementioned plasma P and ejected into the chamber 7. To that end, a temperature controller (not shown in FIG. 5) may be provided and arranged to keep the interceptor 50 at a controlled temperature that is higher then the fuel melting temperature (e.g., 232° C. when tin is used as the fuel). Desirably the temperature is not too low, so that the fuel solid micro-particles may be melted quickly, but the temperature is desirably not too high, because too high of a temperature may have negative effects. For example, a high fuel saturation pressure which results in low EUV light transmission or a high temperature in the region between the plasma P and radiation collector 10 may increase the rate of fuel deposition on the radiation collector surface 10*s*. In an embodiment, the temperature of the fuel particulate interceptor 50 may be about 450° C. In this example, the interceptor may further comprise a heater (not shown) configured to heat the fuel particulate interceptor to a temperature greater than the melting temperature of the fuel. However, due to the plasma formation, the working temperature may be high enough to suitably render the fuel particulate interceptor 50 heated to a temperature where the fuel can be kept liquefied and where the heating is essentially provided by plasma formation. It may even be convenient to provide cooling, using said temperature controller such as to keep the interceptor within the correct working range.

At the temperature of 450° C., particulate debris that reaches the fuel particulate interceptor surface is melted or kept in liquid phase, so that a liquid layer is formed on the fuel particulate interceptor surface. The gravitation field (represented by the arrow g) may force the fuel in the layer to move towards a liquid fuel removal line or outlet 52 and surface tension forces should keep the liquid layer attached to the fuel particulate interceptor 50. In this way, the fuel debris may be removed from the fuel particulate interceptor 50 and subsequently from the chamber 7 of the radiation source. Although the outlet 52 may be shaped in a channel form, the orientation of the cylindrical interceptor 50 may in itself define a direction of flow, without further specific design for an outlet 52.

FIG. 5 represents an orientation of the chamber 7 in working condition, that is, the chamber is kept under an angle relative to the direction of gravity. In this orientation, desirably, the fuel particulate interceptor 50 is constructed and arranged to shield at least the chamber walls 55 that are provided, in a working condition, above the collector 10. FIG. 5 further shows that the chamber 7 is a vacuum chamber coupled to a vacuum pump 57. An illustrative chamber has pressure ranges between 50-200 Pa. The chamber 7 is provided with a pressure lock 56 arranged near the intermediate focus IF, i.e. near the secondary focus of the collector 10. In this example, the pressure lock 56 is a Peclet suppressor, and may include a conically shaped aperture. This pressure lock 56 arranges a pressure balance between the vacuum pressure of the plasma reaction chamber 7 and the vacuum pressure of the illuminator, substantially conform the arrangement of FIG. 2. This vacuum pressure may be substantially lower than the plasma reaction chamber pressure, for example, 3% of the plasma reaction chamber pressure. A shield may be arranged to shield the plasma formation site from a line of sight from the aperture.

Figure 6:
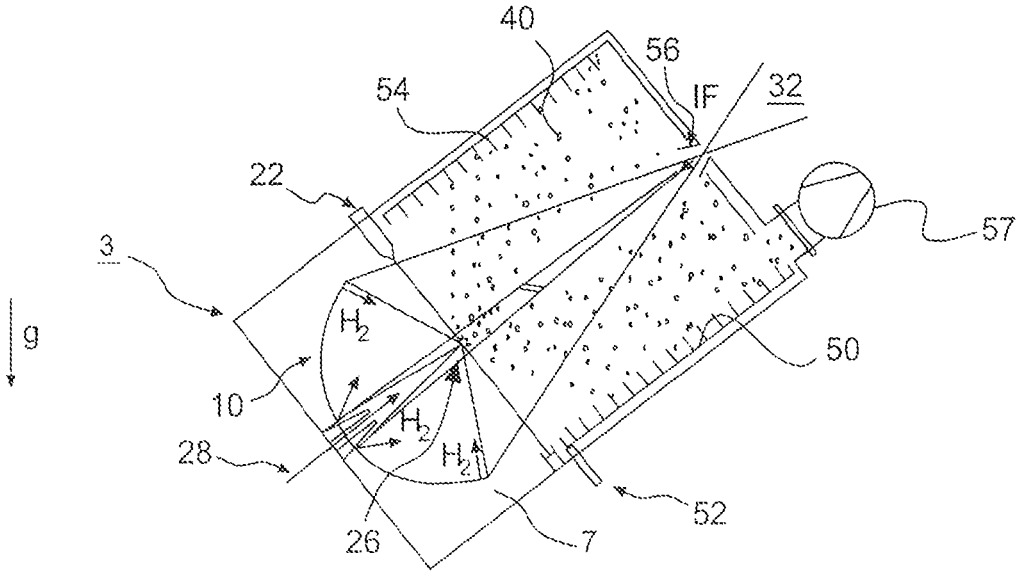
FIG. 6 depicts the source module illustrated in FIG. 5 including debris trapping foils in accordance with an embodiment of the invention.

As illustrated in FIG. 6, an embodiment of the fuel particulate interceptor may include one or more foils 54 arranged to trap debris and particulates. The foils 54 may be mechanically coupled to a wall of the fuel particulate interceptor 50. A foil 54 may be platelet directing generally to the plasma formation site 26 in order to prevent the risk of particles (droplets) from travelling in the direction of the radiation collector 10 after the particles impact the surface of the drum 50. It is noted that a conventional foil trap, in contrast to the present interceptor 50 including debris-trapping foils 54, is designed to allow passage of extreme ultraviolet radiation as exemplified by the contamination trap 34 in FIG. 4.

Figure 7:
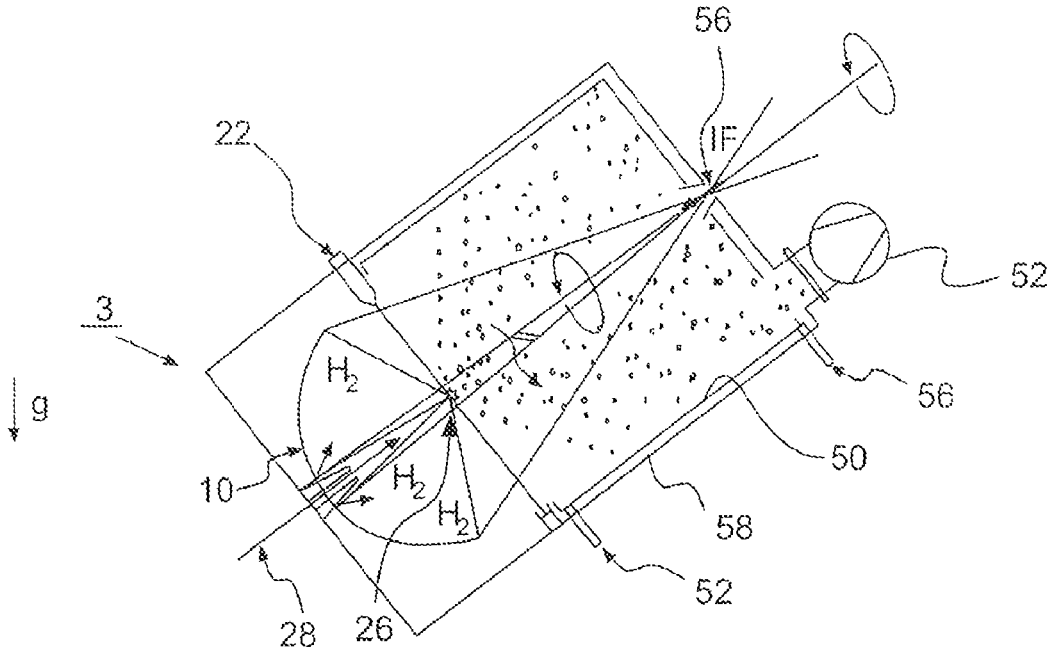
FIG. 7 depicts a source module including a rotatable fuel particulate interceptor in accordance with an embodiment of the invention.

As indicated in FIG. 7, the fuel particulate interceptor 50 may, in an embodiment, be rotatable around a rotation axis. Movement of the fuel towards the outlet 52 may be facilitated by rotating the fuel particulate interceptor 50 desirably around its rotation axis. The rotation axis may be oriented along a direction different from the direction of gravity. Without being bound to theory, due to rotation, fuel particulates will coagulate and arrange in a lower part of the interceptor 50, thus preventing a possible droplet built up in the interceptor 50 on surfaces above the collector 10. To promote coagulation of the fuel, additionally liquid fuel may be added along a fuel line 58 from a liquid fuel flow inlet 56 at the end opposite to the outlet 52, as illustrated in FIG. 7. The rotating movement of the interceptor will promote an even distribution of intercepted particulates along the walls of the interceptor, thereby preventing excessive contamination of a wall portion of the fuel particulate interceptor 50 due to the dominant direction of fuel particulates. Rotatability of the fuel particulate interceptor may be arranged with or without a heater. The interceptor may be cleaned after a subsequent period of use. In an embodiment, all of the aforementioned features of the fuel particulate interceptor 50 and the foils 54 may be implemented simultaneously.

Figure 8:
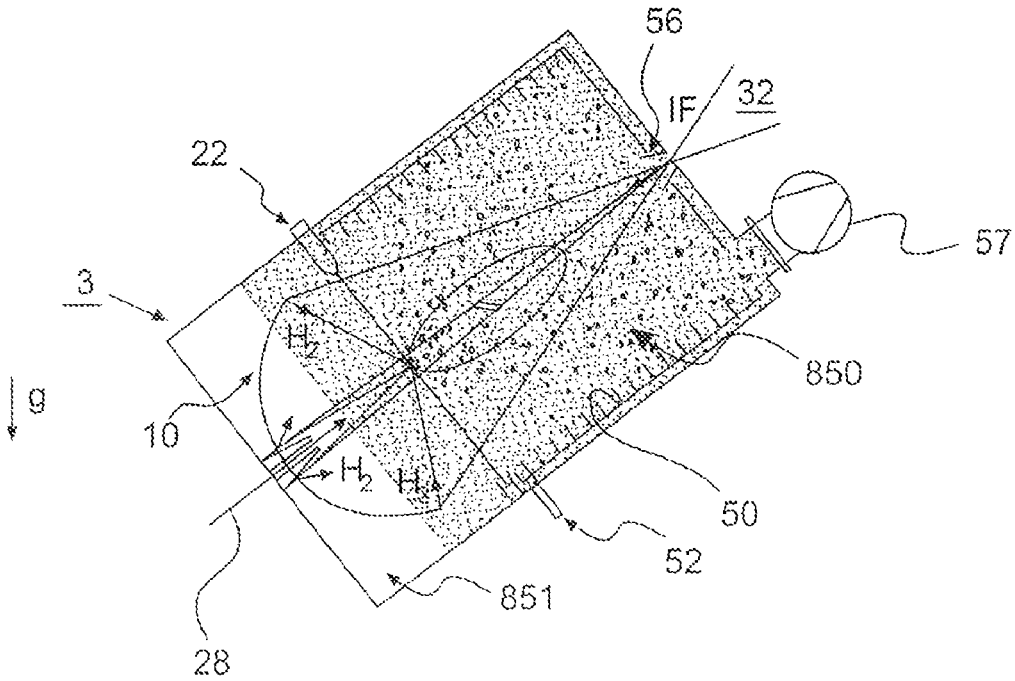
FIG. 8 depicts a temperature distribution in a source module of a radiation source in accordance with an embodiment of the invention.

FIG. 8 illustrates an example of a temperature distribution within the radiation source upon the installation and use of the fuel particulate interceptor 50 in accordance with embodiments of the invention. As illustrated, the interceptor is heated to an extent that there is a hot relatively region 850 between the plasma P and the intermediate focus IF, and a region 851 between the radiation collector 10 and the plasma P which is relatively cold compared to the temperature of region 850. Such a temperature distribution may allow for an increase in the pressure in the source without an increase in the EUV light absorption. At a higher source pressure, the flow of hydrogen may mitigate the debris from the plasma more effectively, and the ions may be stopped farther from the radiation collector 10, which may lengthen the lifetime of the radiation collector 50.

Embodiments illustrated in FIGS. 9A and 9B, and FIGS. 10A and 10B may allow for the fuel particulates to be removed from a fuel particulate interceptor 80, which may be in the form of a central cone. The fuel particulate interceptor 80 includes an upper part 82 and a lower part 84. The fuel particulates may then be directed or dropped into to a collection location, for example, a tin collector in embodiments where the fuel comprises tin.

Figure 9B:
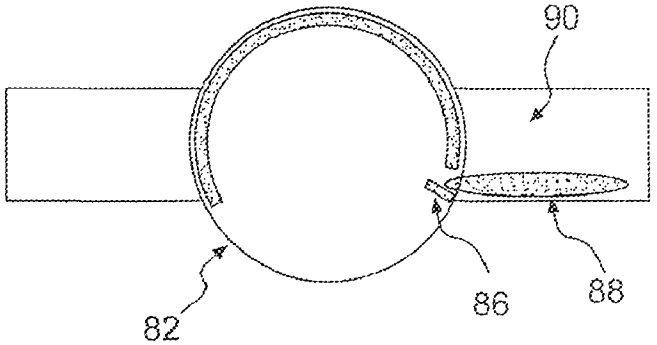
FIG. 9B depicts a front view of the part of the radiation source of FIG. 9A.
Figure 9A:
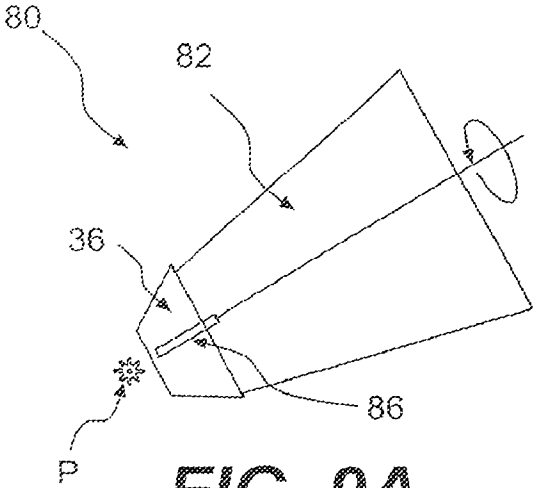
FIG. 9A depicts a side view of a part of a radiation source in accordance with an embodiment of the invention.

FIGS. 9A and 9B illustrate an embodiment of the radiation source that may either prevent the fuel from collecting at an upper part 82 of the fuel particulate interceptor 80 or may allow any fuel that has collected to be transported by rotating the upper part 82 of the fuel particulate interceptor 80 around its axis and installing a fuel remover 86 at a collection location 88 where the fuel particulates can be transported away from the source, such as in a so-called central shadow 90. This will collect the fuel in the lower part 84 of the fuel particulate interceptor 80 so that the fuel can be further transported.

Figure 10B:
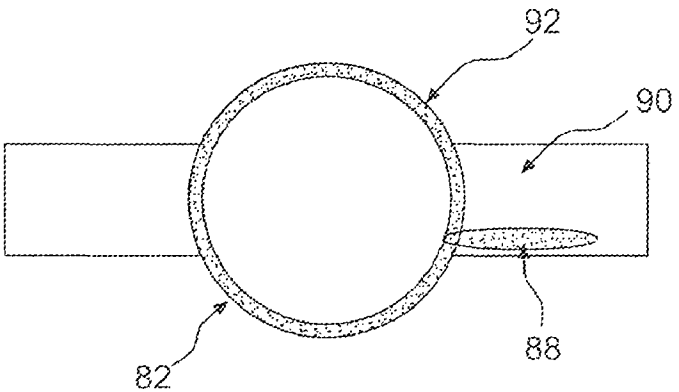
FIG. 10B a front view of the part of the radiation source of FIG. 10A.
Figure 10A:
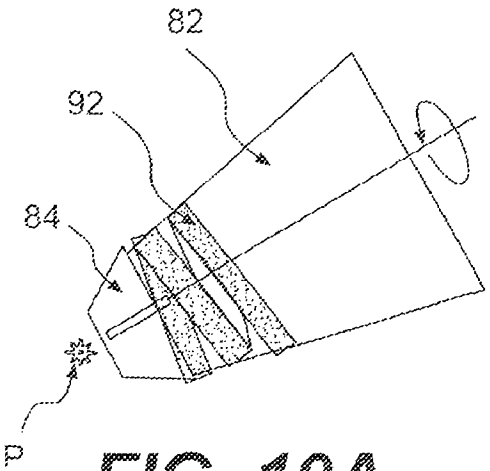
FIG. 10A depicts a side view of a part of a radiation source in accordance with an embodiment of the invention.

FIGS. 10A and 10B illustrate an embodiment wherein the foil trap is constructed in spiraling fashion along a rotation axis so as to direct fuel particulates that have collected on the fuel particulate interceptor and melted into a liquid form towards a fuel outlet. This design also known as an Archimedes screw 92 may replace the rotating part 82 of the fuel particulate interceptor 80. The screw 92 is configured to transport the fuel to the removal region 88.

In some aspects, although the disclosed embodiments discuss placement of the fuel particulate interceptor placed 'above' a reflective element, in another aspect, the fuel particulate interceptor may be arranged in a dominant direction of the particulate formation. In particular, in such embodiments, a fuel particulate interceptor may be arranged to shield at least part of the chamber from fuel particulates emitted by the plasma, to prevent formation on the wall of a dominant contamination region.

In some aspects, the invention may be characterized by a radiation source configured to generate extreme ultraviolet radiation, the radiation source comprising: a chamber; a fuel supply configured to supply a fuel to a plasma formation site within the chamber; a laser configured to emit a beam of radiation to the plasma formation site so that a plasma that emits extreme ultraviolet radiation is generated when the beam of radiation impacts the fuel; a fuel particulate interceptor configured to shield at least part of the chamber from fuel particulates emitted by the plasma; a heater configured to heat the fuel particulate interceptor to a temperature greater than the melting temperature of the fuel; and a fuel outlet constructed and arranged to allow excess fuel and at least some of the fuel particulates to exit the chamber.

The heater may be formed by the plasma formation so that no additional heater is needed. In addition, fuel particulates adhered to the interceptor 50 may be removed by other removing means, such as chemical removal.

Although specific reference may be made in this text to the use of lithographic apparatus in the manufacture of ICs, it should be understood that the lithographic apparatus described herein may have other applications, such as the manufacture of integrated optical systems, guidance and detection patterns for magnetic domain memories, flat-panel displays, liquid-crystal displays (LCDs), thin-film magnetic heads, etc. The skilled artisan will appreciate that, in the context of such alternative applications, any use of the terms "wafer" or "die" herein may be considered as synonymous with the more general terms "substrate" or "target portion", respectively. The substrate referred to herein may be processed, before or after exposure, in for example a track (a tool that typically applies a layer of resist to a substrate and develops the exposed resist), a metrology tool and/or an inspection tool. Where applicable, the disclosure herein may be applied to such and other substrate processing tools. Further, the substrate may be processed more than once, for example in order to create a multi-layer IC, so that the term substrate used herein may also refer to a substrate that already contains multiple processed layers.

The term "lens", where the context allows, may refer to any one or combination of various types of optical components, including refractive, reflective, magnetic, electromagnetic and electrostatic optical components.

While specific embodiments of the invention have been described above, it will be appreciated that the invention may be practiced otherwise than as described. The descriptions above are intended to be illustrative, not limiting. Thus, it will be apparent to one skilled in the art that modifications may be made to the invention as described without departing from the scope of the claims set out below.

What is claimed is:

1. A source module for a lithographic apparatus, the source module comprising:

a chamber defined by chamber walls;

an extreme ultra violet radiation generator including a fuel supply configured to supply a fuel to a plasma formation site within the chamber;

a reflective element in the chamber configured to reflect extreme ultraviolet radiation emanating from a radiation emission point at the plasma formation site; and a fuel particulate interceptor, arranged in the chamber adjacent to one or more of the chamber walls and comprising a material having an affinity for the fuel, the fuel particulate interceptor further comprising a wall and a plurality of foils extending from the wall, the plurality of foils being configured to trap fuel particulates that impact the fuel particulate interceptor and to substantially block passage of extreme ultraviolet radiation incident on the plurality of foils.

2. The source module according to claim 1, wherein the fuel particulate interceptor further comprises a fuel outlet, wherein the fuel particulate interceptor is constructed and arranged to direct fuel particulates that have collected on the fuel particulate interceptor and melted into a liquid form towards the fuel outlet.

3. The source module according to claim 1, wherein the chamber walls include a first chamber wall that is that is provided, in a working condition, above the reflective element, and wherein the fuel particulate interceptor is constructed and arranged to shield the first chamber wall.

4. The source module according to claim 1, further comprising a temperature control system configured to keep the fuel particulate interceptor at a temperature greater than the melting temperature of the fuel.

5. The source module according to claim 4, wherein the fuel comprises tin and the fuel particulate interceptor material comprises molybdenum.

6. The source module according to claim 1, wherein the plurality of foils are attached to the fuel particulate interceptor wall.

7. The source module according to claim 1, wherein the fuel particulate interceptor is rotatable.

8. The source module according to claim 1, further comprising a fuel inlet constructed and arranged to provide fuel to a surface of the interceptor.

9. The source module according to claim 1, wherein the chamber is a vacuum chamber.

10. The source module according to claim 1, further comprising a fuel particulate remover constructed and arranged to remove collected fuel particulates from the fuel particulate interceptor so that the fuel particulates flow toward a fuel outlet.

11. A radiation source configured to generate extreme ultraviolet radiation, the radiation source comprising:

a fuel supply configured to supply a fuel to a plasma formation site;

a laser configured to emit a beam of radiation to the plasma formation site so that a plasma that emits extreme ultraviolet radiation is generated when the beam of radiation impacts the fuel;

a fuel particulate interceptor constructed and arranged to shield at least part of the radiation source from fuel particulates that are emitted by the plasma, the fuel particulate interceptor comprising a first portion and a second portion, the second portion being positioned closer to the plasma formation site relative to an intermediate focus than the first portion, and the first portion being rotatable; and a fuel particulate remover constructed and arranged to remove fuel particulates from an interior surface of the fuel particulate interceptor and to direct the fuel particulates towards a collection location.

12. The radiation source according to claim 11, wherein the fuel particulate remover comprises one of a wiper constructed and arranged to wipe the surface, a blade constructed and arranged to scrape the surface, and an Archimedes screw constructed and arranged to contact the surface and convey the fuel particulates to the collection location.

13. A lithographic apparatus comprising:

a source module comprising a chamber defined by chamber walls, an extreme ultra violet radiation generator including a fuel supply configured to supply a fuel to a plasma formation site within the chamber, a reflective element in the chamber configured to reflect extreme ultraviolet radiation emanating from a radiation emission point at the plasma formation site, and a fuel particulate interceptor, arranged in the chamber adjacent to one or more of the chamber walls and comprising a material having an affinity for the fuel, the fuel particulate interceptor further comprising a wall and a plurality of foils extending from the wall, the plurality of foils being configured to trap fuel particulates that impact the fuel particulate interceptor and to substantially block passage of extreme ultraviolet radiation incident on the plurality of foils; and a projection system configured to project patterned extreme ultraviolet radiation onto a substrate.

14. A lithographic apparatus comprising:

a radiation source configured to generate extreme ultraviolet radiation, the radiation source comprising a fuel supply configured to supply a fuel to a plasma formation site, a laser configured to emit a beam of radiation to the plasma formation site so that a plasma that emits extreme ultraviolet radiation is generated when the beam of radiation impacts the fuel, a fuel particulate interceptor constructed and arranged to shield at least part of the radiation source from fuel particulates that are emitted by the plasma, the fuel particulate interceptor comprising a first portion and a second portion, the second portion being positioned closer to the plasma formation site relative to an intermediate focus than the first portion, and the first portion being rotatable, and a fuel particulate remover constructed and arranged to remove fuel particulates from an interior surface of the fuel particulate interceptor and to direct the fuel particulates towards a collection location; and a projection system configured to project patterned extreme ultraviolet radiation onto a substrate.

* * * * *